US006109331A

United States Patent [19]

Story, Jr.

[11] Patent Number: 6,109,331

[45] Date of Patent: Aug. 29, 2000

[54] SCREEN FRAME AND SCREEN DOOR

[76] Inventor: Paul J. Story, Jr., 812 E. Worthington Ave., Charlotte, N.C. 28203

[21] Appl. No.: 09/192,612

[22] Filed: Nov. 16, 1998

Related U.S. Application Data

[60] Provisional application No. 60/066,574, Nov. 26, 1997.

[51] Int. Cl.[7] ..... A47G 5/00

[52] U.S. Cl. ..... 160/371; 160/369

[58] Field of Search ..... 160/371, 369, 160/381, 376, 377, 380

[56] References Cited

U.S. PATENT DOCUMENTS

| | | | |
|---|---|---|---|
| D. 307,078 | 4/1990 | Guillemet | D8/382 |
| 1,002,781 | 9/1911 | Swart . | |
| 1,030,694 | 6/1912 | Watson et al. . | |
| 1,524,261 | 1/1925 | Kusterle . | |
| 1,659,101 | 2/1928 | Harvey . | |
| 1,695,091 | 12/1928 | Everhard | 160/371 X |
| 1,722,947 | 7/1929 | Schneider et al. | 160/381 X |
| 1,725,937 | 8/1929 | Rosel . | |
| 1,773,731 | 8/1930 | Haskell . | |
| 2,139,423 | 12/1938 | Scheeler | 189/79 |
| 2,204,761 | 6/1940 | Lang | 160/369 |
| 2,291,726 | 8/1942 | Kaufmann | 160/371 |
| 2,616,197 | 11/1952 | Osburn | 40/152 |
| 2,621,764 | 12/1952 | Humphrey | 189/77 |
| 2,972,396 | 2/1961 | Minick | 189/36 |
| 3,097,684 | 7/1963 | Le Tarte | 160/381 X |
| 3,379,237 | 4/1968 | Worthington | 160/371 |
| 3,461,940 | 8/1969 | Brynjelson | 160/371 |
| 3,696,373 | 10/1972 | Dunn et al. | 340/273 |
| 3,763,917 | 10/1973 | Antinone | 160/354 |
| 4,090,799 | 5/1978 | Crotti et al. | 403/401 |
| 4,168,922 | 9/1979 | Worrallo | 403/231 |
| 5,018,263 | 5/1991 | Stern | 160/371 X |
| 5,473,853 | 12/1995 | Guillemet | 52/745.16 |
| 5,547,011 | 8/1996 | Dotson et al. | 160/381 |
| 5,881,525 | 3/1999 | Riegelman et al. | 160/381 X |

*Primary Examiner*—David M. Purol
*Attorney, Agent, or Firm*—Dougherty & Associates

[57] ABSTRACT

The present invention is a screen frame and screen positionable in most window frames and door frames. The invented screen frame is comprised of four screen frame segments joined together at corners to form a generally rectangular or multi-sided screen frame. Corner joint inserts are inserted in each corner of the four screen frame segments and the inserts are spot welded to adjoining screen frame segments to provide a sturdy and rigid screen frame. The screen frame segments are preferably stainless steel extrusions having two parallel flanges extending from a generally square shaped hollow body. An alternative construction of the screen frame is a continuous extruded segment that is notched at certain locations for bending and forming into a continuous screen frame having one junction requiring spot welding. A metal, preferably stainless steel screen is secured in the screen frame by spot welding the screen between the screen frame flanges of the screen frame segment. Stainless steel support pins are used to secure the screen frame enclosing the screen in a window frame casing. The screen frame and screen provides a long-lasting, corrosive resistant, and rigid frame and screen for positioning in window or door frames which withstand damage from intruders, projectiles, and environmental stresses.

16 Claims, 7 Drawing Sheets

Fig.2
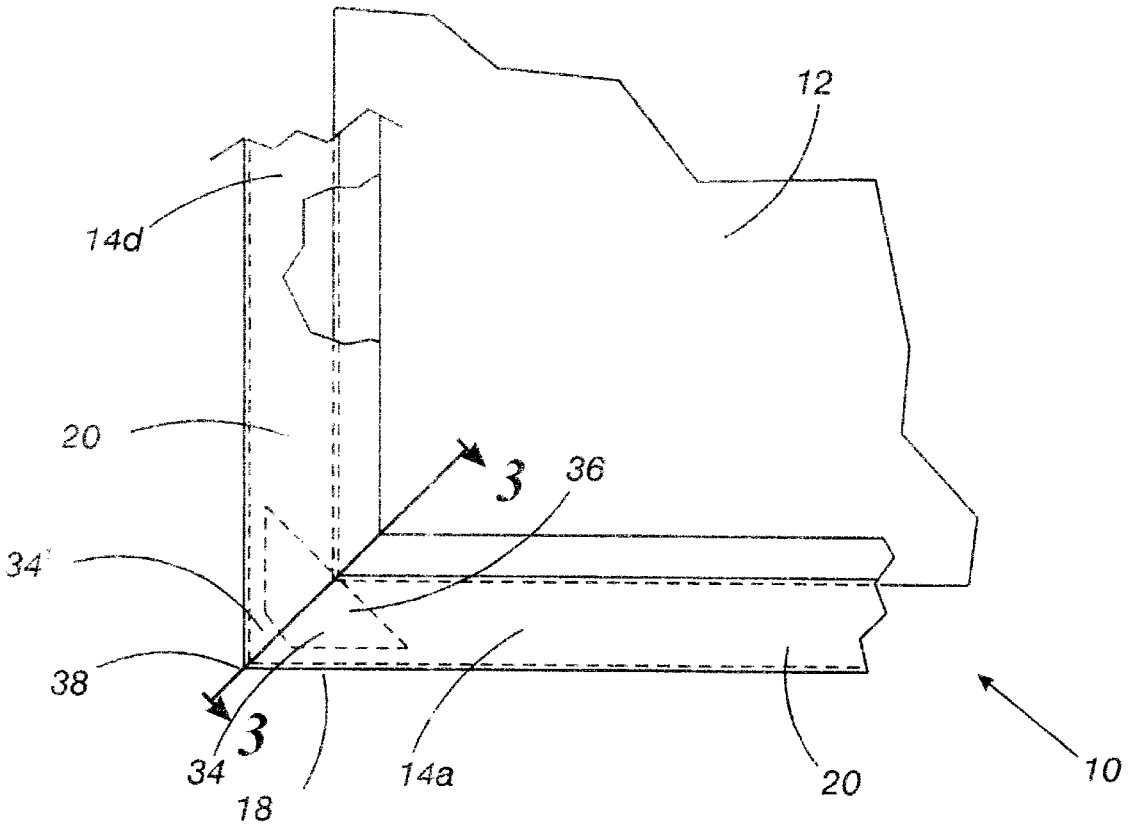
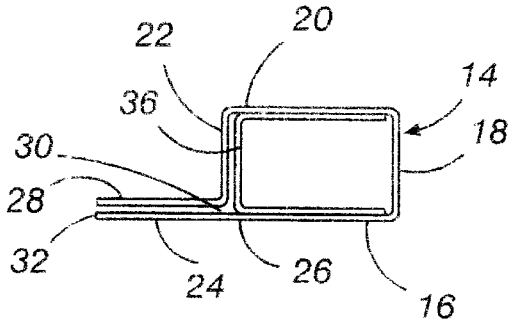
Fig.3

Fig.4
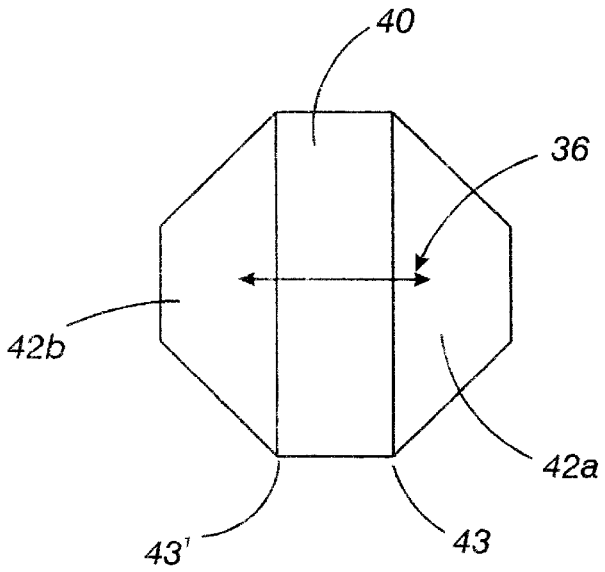
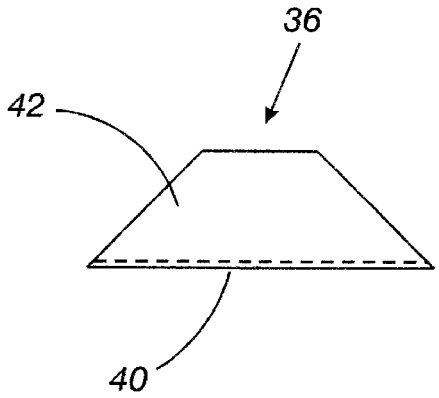
Fig.6
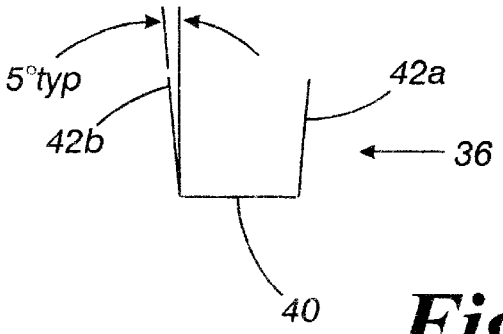
Fig.5

Fig. 7
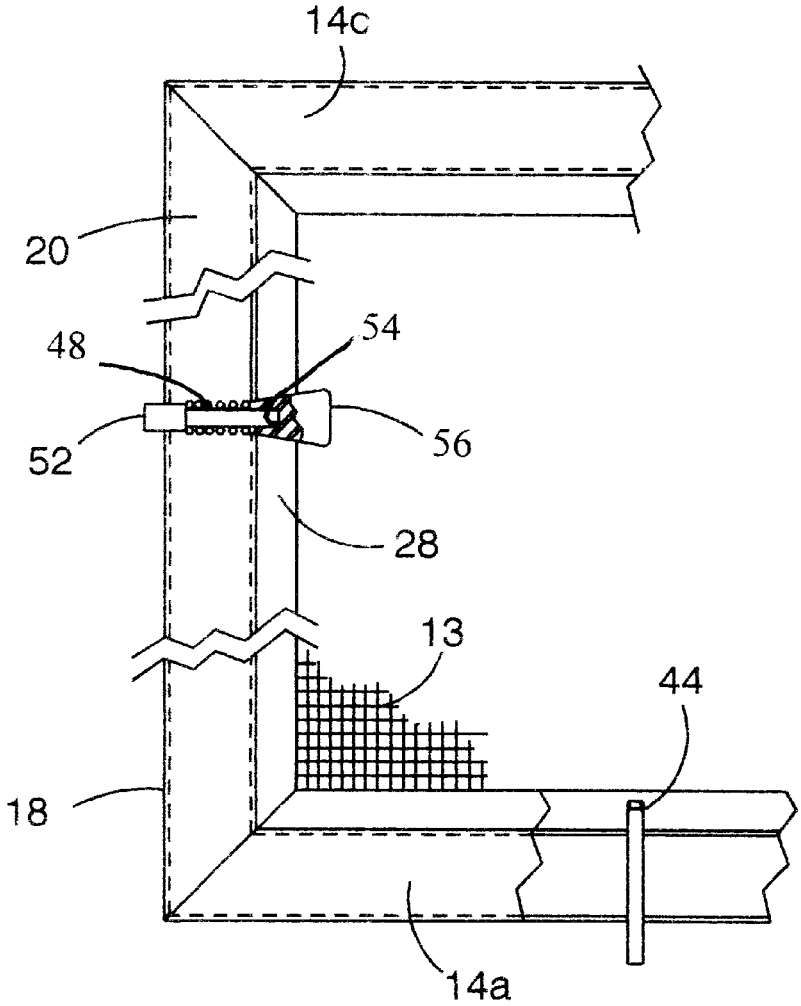
Fig. 8
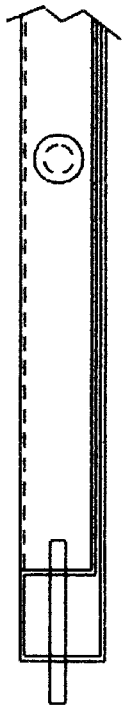
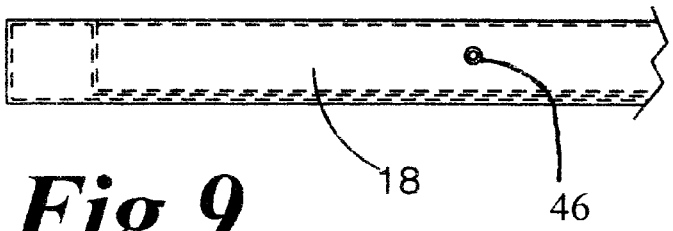
Fig. 9

SCREEN FRAME AND SCREEN DOOR

This application claims benefit of provisional application Ser. No. 60/066,574 filed Nov. 26, 1997.

FIELD OF THE INVENTION

The present invention relates to window screens and screen doors. More particularly, the invention relates to a sturdy, rigid, and durable stainless steel screen frame and stainless steel screen capable of resisting damage from intruders, projectiles, and environmental stresses.

BACKGROUND OF THE INVENTION

Screens are often used to prevent everything except air from entering through windows when the window panes are in open positions. Screens are also used in conjunction with doors for similar reasons. Screens are effective in preventing bugs and small animals from entering a structure. However, screens are ineffective in preventing a potential intruder, human or animal, from entering the structure when the window pane or door is left open. Also, screens are ineffective in preventing most projectiles from breaking through a screen and entering the structure.

Existing screens for windows and doors are typically constructed of aluminum frame segments and fiberglass, metal wire, or nylon screens. A typical screen frame has four segments which are joined together to form a rectangle. Each of the segments has a rectangular cross-section with an axial groove in the interior side of each segment for accepting and securing the screen. The ends of the adjoining segments are typically secured together with brackets positioned inside the segments. The interior brackets are generally screwed or bolted in place, providing gaps where the ends of adjoining segments abut at the corners.

After the correct size screen frame is positioned in a window frame or door frame, a sheet of screen is cut to fit the screen frame. Normally, the area of the screen is larger than the interior area of the screen frame so that when the screen is placed in the frame, the edges of the screen can be placed in the axial grooves. A rubber strip having a diameter or thickness roughly equal to the width of the axial groove is forced into the axial groove to secure the screen in the frame. Extraneous screen material is then cut off and discarded.

While existing screen frames and screens are inexpensive, they offer very little in the way of rigidity or protection against damage by projectiles, intruders, and the elements. First, such screens are constructed out of materials that have inferior characteristics compared to metal screens. Fiberglass or nylon screening can be easily cut or torn and, therefore, offers very little resistance to a potential intruder or a projectile. In addition, the frame segments are made from a material which can be readily destroyed and which offer little resistance to external pressure applied during forcible removal or entry through a window frame. Finally, the frame corners where the screen frame segments are joined, are insufficiently sturdy to offer protection against damage. Consequently, windows and doors cannot be left unlocked and/or open without exposing the occupants to a real threat of intrusion from people and animals. Therefore, existing screen frames and screens are incapable of providing the desired level of safety required in modern society.

Second, the materials used to make existing screens and screen frame segments render the screen frames and screens subject to deterioration from the sun, wind, and rain. This deterioration is especially problematic in areas near the ocean where salt water in the air is very corrosive.

The inferiority of existing screen frames and screens makes them uneconomical in the long run. It is not uncommon in some environments that screen frames and screens deteriorate so badly that they must be replaced very often. Also, wear and tear and general deterioration make the screens unsightly and aesthetically unpleasing. As a consequence, great expense is required to maintain existing screens in an operable condition. Finally, existing screens have very little recyclable material making their disposal problematic.

Therefore, needs exist for a long-lasting and cost-effective screen frame and screen that is sturdy and durable and that overcomes the above mentioned problems inherent in existing screen frames and screens.

While there are numerous methods and apparatus for screening windows and doors, none are known to have an equivalent structure to, or to function in the manner of, the present invention.

SUMMARY OF THE INVENTION

The present invention is an apparatus for screening a window or door. The present invention includes appropriate structures and materials to create sturdy and durable screen frames and screens positionable in a window frame or door frame.

During normal operation, the metal screen frame is formed from four screen frame segments which are joined and welded together to give the screen frame a square or rectangular shape. The screen frame segments are forms, preferably stainless steel extrusions, having a bottom side, an outer side, a top side, and an inner side that give the screen frame segments a generally rectangular cross-section. At least one corner joint insert, having a trapezoid shape, is positioned in the interior portion of the corners of adjacent screen frame segments. Each corner joint insert has two extensions from a central axis, and each extension is placed in contact with the interior surfaces of corner segments of each screen frame segment. The interior surfaces of corners of adjacent screen frame segments and the surfaces of the corner joint insert extensions are welded in place, providing rigidity to the square or rectangular screen frame. A first flange of each of the four screen frame segments extends from the bottom side of each screen frame segment and a second flange extends from the inner side of each screen frame segment such that the second flange is generally parallel to the first flange which creates a gap between the first and second flanges. The width of the gap between the first and second flange is roughly ⅛ inch, or the same as the thickness of a screen inserted in conjunction with the screen frame. An insertable metal screen has edges placed within the gap, and is welded between the first and second flanges which forms a continuous rigid screen within the interior of the rigid screen frame segments.

The invented screen frame and screen provides a long-lasting economical means for screening a window frame or door frame.

OBJECTS OF THE INVENTION

Accordingly, one of the objects of the present invention is to provide an apparatus for an economical screened window frame or door frame.

Another object of the invention is to provide a sturdy, rigid, and durable screen frame and screen for preventing damage from intruders, projectiles, and environmental stresses through a window or door.

A further object of the invention is to provide a method of assembling a long-lasting screen frame and screen for minimizing screen frame and screen maintenance.

BRIEF DESCRIPTION OF THE DRAWINGS

In view of these and other objects which will more readily appear as the nature of the invention is better understood, the invention consists in the novel combination and arrangement of parts hereinafter more fully described, illustrated and claimed with reference being made to the attached drawings, in which:

FIG. 2 is a frontal view of one corner of two screen frame segments joined together with an internally inserted corner joint insert to form the screen frame of FIG. 1;

FIG. 3 is a cross-sectional view of a rectangular screen frame segment and corner joint insert of FIG. 2 taken along line 3—3;

FIG. 4 is a top view of a flattened corner joint insert, before folding and corner insertion of a screen frame segment;

FIG. 5 is a end view of the corner joint insert of FIG. 4 in a preferred configuration;

FIG. 6 is a side view of the corner joint insert of FIG. 4 in a preferred configuration;

FIG. 7 is a frontal view of the upper portion of the screen frame and screen of FIG. 1;

FIG. 8 is a cross-sectional view along line 8—8 in FIG. 7;

FIG. 9 is an end view of the screen frame of FIG. 7;

DETAILED DESCRIPTION

Figure 1:
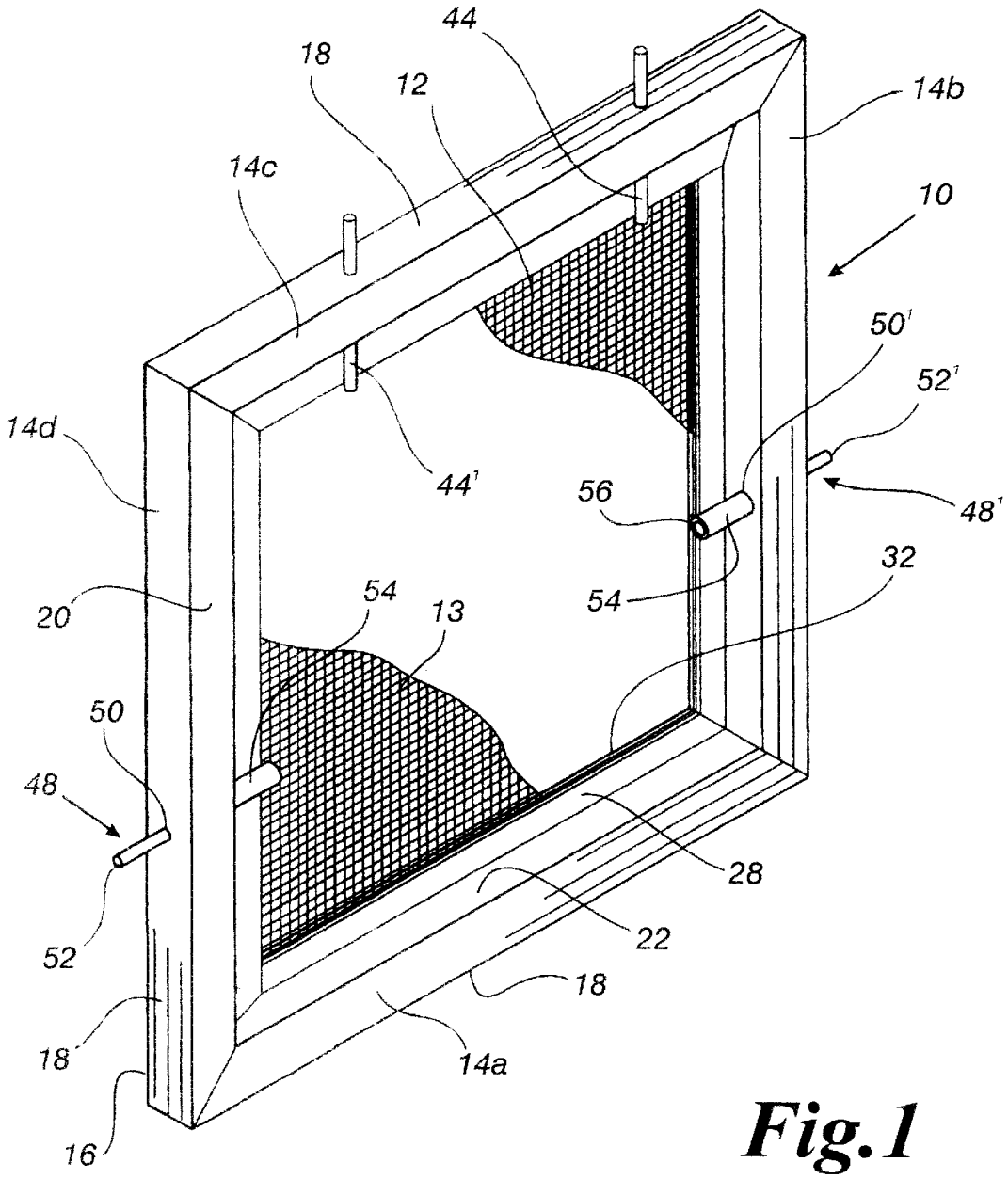
FIG. 1 is an isometric view of a screen frame and screen according to the invention.

The metal screen frame is formed from four screen frame segments which are joined and welded together to give the screen frame a square or rectangular shape. The screen frame segments are forms, preferably stainless steel extrusions, having a bottom side, an outer side, a top side, and an inner side that give the screen frame segments a generally rectangular cross-section. Corner joint inserts, having a trapezoid shape, are positioned in the interior portion of the corners of adjacent screen frame segments. The corner joint inserts have two extensions from a central axis, and each extension is placed in contact with the interior surfaces of corner segments of each screen frame segment. The interior surfaces of corners of screen frame segments and surfaces of corner joint insert extensions are welded in place, providing rigidity to the square or rectangular screen frame. A first flange of each of the four screen frame segments extends from the bottom side of each screen frame segment and a second flange extends from the inner side of each screen frame segment such that the second flange is generally parallel to the first flange which creates a gap between the first and second flanges. The width of the gap between the first flange and second flange could be roughly the same or greater than the thickness of the screen to be used in conjunction with the screen frame. An insertable metal screen has edges placed within the gap, and welded between the first and second flanges which forms a continuous rigid screen within the interior of the rigid screen frame segments.

The ends of each frame segment are mitered, notched, or relieved so that joining adjacent frame segments create the appearance of a continuous screen frame. Corner joint inserts are positioned in the interior portion of the screen frame segments at the mitered corners of adjacent screen frame segments.

In one embodiment, each corner joint insert is a folded sheet of metal having a U-shaped cross-section. The corner joint inserts have a generally rectangular spine and two extensions extending from the spine. The extensions are oriented such that they extend away from each other about the center line of the spine of each corner joint insert, with each extension forming a flat wall that is parallel to the opposing flat extension with at least five degrees (5°) angle of spread, and preferably between five and eight degrees (5°–8° ) angle of spread. The folds between the spine and the extensions give the corner joint inserts their spring property. The corner joint inserts preferably have a trapezoidal shape.

The corner joint inserts are oriented at the mitered corners of the frame segments with the spine of each corner joint insert proximate to the inner side of the screen frame segments and the outer edges of the extensions proximate to the outer side of the screen frame segments. When the corner joint inserts are positioned in the frame segments, the extensions are forced into a position in which they are generally perpendicular to the spine and are generally parallel to each other. The outward spring force of the parallel facing wall extensions on the frame segments holds the adjacent frame segments in place until the frame segments are spot welded to each corner joint insert.

The corners of two screen frame segments are spot welded to at least one internally placed corner joint insert, thereby providing a very strong connection between the screen frame segments. Preferably, the spot weld will be a rosette weld (one side spot weld) with spot welds on the top side and the bottom side of each frame segment. Thus by joining the mitered corners together, the screen frame segments are formed into one continuous structure having rigidity and forming a rectangular or square frame.

A stainless steel or steel screen is positioned in the gaps between the screen frame segment flanges. The screen is secured to the screen frame segments by spot welding or seam welding the flanges to the screen. Various sizes of screens can be used in combination with the invented screen frame. Examples of acceptable screen material include: 18 mesh 0.009" metal wire cloth, 12 mesh 0.028" metal wire cloth, and 30×0.0065" metal wire cloth. The screen material may be manufactured of 301 stainless steel for the smaller gauge metal wire cloth, or of 304 stainless steel for larger gauge metal wire cloth. Alternative materials of metal or solid fabric sheets may be utilized that provide non-corrosive and rigid properties for the screen materials, including steel plated with nickel or chromium.

A pair of fixed locating pins, preferably made of either stainless steel or hardened steel having nickel or cadmium coatings, are inserted transversely through apertures in one of the screen frame segments and extend beyond the edge of the inner and outer sides or surfaces of the screen frame segment. Preferably, the locating pins are inserted through apertures in the top screen frame segment or the bottom screen frame segment. The portion of the locating pins extending beyond the outer side of the top or bottom screen frame segment are insertable through corresponding holes or slots in the window frame casing.

Alternately, spring loaded support pins, preferably made from either stainless steel or hardened steel coated with cadmium or nickel, are positioned in bores through the left and right screen frame segments. The spring loaded support pins are positionable in corresponding holes or slots in the window frame casing. The spring loaded support pins allow the screen frame to be removably positioned in a window frame. Multiple fixed locating pins and multiple spring loaded support pins can be used depending upon the length of the screen frame segments. Finally, the fixed locating pins and the spring loaded support pins are preferably positioned on the interior of the screen frame, so that they can only be accessed from the inside of the window frame by a household occupant.

PREFERRED EMBODIMENT

Referring now to the drawings, FIGS. 1–3 and 7–9 show a first embodiment of the invented screen frame 10 and screen 12 for screening a window or door. The invented screen frame 10 includes four screen frame segments 14*a,* 14*b,* 14*c,* 14*d* joined together at corners to form a generally rectangular shaped screen frame 10. Three screen frame segments (not shown) would be used to form a triangle screen frame enclosing a screen, and additional screen frames may be used for windows having more than four sides.

The screen frame segments 14 are preferably stainless steel extrusions having a back side 16, an outer facing, or outer perimeter side 18 extending generally perpendicular from the bottom side 16, a front facing side 20 extending generally perpendicular from the outer side 18 and generally parallel to the back side 16, and an inner side or interior perimeter 22 extending generally perpendicular from the front facing side 20 and generally parallel to the outer side 18.

As shown in FIGS. 2–3, for each screen frame segment 14, a first flange 24 extends from the back end 26 of the back side 16 to a point beyond the plane of the interior perimeter 22. A second flange 28 extends from the lower end or corner 30 of the inner perimeter 22 generally perpendicular to the interior perimeter 22 and generally parallel to the first flange 24. A gap 32 is formed between the first flange 24 and second flange 28. The width of the gap 32 is roughly the same as the thickness of the screen 12 to be used in conjunction with the screen frame 10, which may require a gap 32 of approximately ¼ inch to approximately 1/64 inch, preferably about ⅛ inch to about 3/16 inch wide gap 32.

As shown in FIG. 2, the ends 34, 34' of each frame segment 14 are mitered such that adjoining adjacent frame segments 14*a* and 14*b,* 14*b* and 14*c,* or 14*c* and 14*d,* creating the appearance of a continuous screen frame. The continuous screen frame, made from stainless steel, provides a rigid frame that does not flex significantly if subjected to twisting or bending by intruders, projectiles, or environmental stresses.

As shown in FIGS. 4–6, a corner joint insert 36 is positioned in each corner 38 where two screen frame segments 14 meet such that half of the corner joint insert 36 is located inside each of the adjacent screen frame segments 14 (see FIG. 2).

In one embodiment, each corner joint insert 36 is a folded sheet of metal to form a U-shaped cross-section (see FIG. 5). The corner joint inserts 36 have a generally rectangular spine 40 and two extensions 42*a,* 42*b* extending from the spine 40. The extensions 42*a,* 42*b* are oriented such that they extend away from each other about the center line of the spine at least five degrees and preferably between five and eight degrees (see FIG. 5). The folds 43, 43' between the spine 40 and the extensions 42*a,* 42*b* give the corner joint inserts 36 their spring property. The extensions 42*a,* 42*b* preferably have a quadrilateral shape such as a trapezoidal shape, or as an alternate, a trilateral shape such as a triangular shape (not shown).

The corner ends 34, 34' of each frame segment 14 are oriented in the mitered corners 38 of the frame segments 14 with the spine 40 of each corner joint insert 36 adjacent to the inner surface of the interior perimeter 22 of the screen frame segments 14. The outer edges of the extensions 42*a,* 42*b* are proximate to the interior surface of the outer perimeter 18 of the screen frame segments 14. When the corner joint inserts 36 are positioned in the frame segments 14, the extensions 42*a,* 42*b* are forced into a position in which they are generally perpendicular to the spine 40 and are generally parallel to each other. The spring force of the extensions 42*a,* 42*b* on the frame segments 14 holds the adjacent frame segments 14 in place before spot welding occurs.

The corners 38 of each screen frame segment 14 are spot welded to the corner joint inserts 36, thereby providing a very strong connection between the screen frame segments 14. Preferably, the spot weld will be a rosette weld with a spot weld on the front facing side 20 and the back side 16 of each frame segment 14.

Thus, by joining the mitered corners 38 together, the screen frame segments 14 are formed into one structural rectangular frame 10.

A stainless steel screen 12 is positioned in the gaps 32 between the screen frame segment flanges 24, 28. The screen 12 is secured to the screen frame segments 14 by spot welding, rosette welding, or seam welding the flanges 24, 28 to the screen 12.

Various sizes of screens can be used in combination with the invented screen frame 10.

As shown in FIG. 1, a pair of fixed locating pins 44, 44' are inserted through apertures 46 in the upper screen frame segment 14*c* and extend beyond the plane of the inner side 22 and the outer side 18 of the screen frame segment 14*c*. The portion of the locating pins 44, 44' extending beyond the outer perimeter side 18 of the screen frame segment 14*c* are insertable through corresponding holes or slots in the window frame casing.

A pair of spring loaded support pins 48, 48' are positioned in bores 50, 50' formed in the right screen frame segment 14*b* and the left screen frame segment 14*d*. The spring loaded support pins 48 have a first end 52 extending beyond the plane of the outer side 18 of the screen frame segment 14 and a second end 54 having a gripable head 56 which extends beyond the plane of the inner side 22 of the screen frame segment 14. A spring (not shown) is positioned around each of the spring loaded support pins 48, 48' inside the screen frame segments 14 such that the springs are compressed when the head 56 of the spring loaded support pins 48, 48' are pulled toward the center of the screen frame 10.

The spring loaded support pins 48, 48' are positionable in corresponding holes or slots in the window frame casing. The spring loaded support pins 48 allow the screen frame 10 to be removably positioned in a window frame casing.

Installing the screen frame 10 and screen 12 in a window frame involves positioning the fixed support pins 44 in corresponding holes or slots in the window frame, pulling the heads 56 of the spring loaded support pins 48 away from the screen frame segments 14, positioning the screen frame 10 to align the first end 50 of the spring loaded support pin with the corresponding holes or slots in the window frame, and then releasing the heads 56 such that the first ends 52 of the spring loaded support pins 48 are positioned in the corresponding holes. Finally, the support pins 44, 48 are preferably positioned on the interior of the screen frame 10 so that they can only be accessed from the inside of the window frame by a household occupant.

ALTERNATIVE EMBODIMENTS

In addition to having screen frame segments with a generally rectangular cross-section, the frame segments may be generally cylindrical or oval (not shown) of stainless steel extrusions, having a first flange and a generally parallel second flange extending from opposite sides of the generally cylindrical or oval extrusions. Other metals may be utilized that provide low corrosion, ease of spot welding, and high rigidity properties. It is also within the scope of this invention to roll form the screen frame segments. The generally rectangular, triangular, or multisided frame, when assembled, may have a reinforcing central bar (not shown) that extends approximately mid-width across the installed screen, from one inside frame surface to an opposing inside frame surface.

Figure 15:
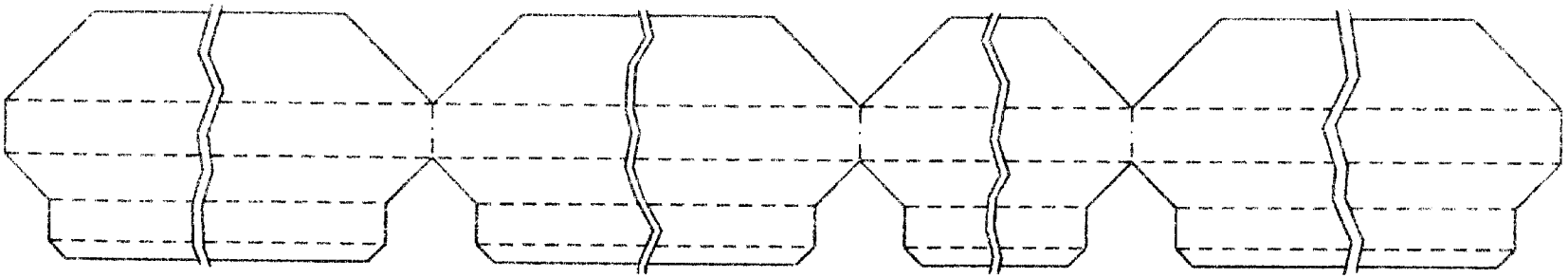
FIG. 15 is a top view of the alternate notched continuous screen frame segment before bending to form a screen frame.

An alternative embodiment may include producing a continuous screen frame for screening in a window frame or door frame, which includes a continuous screen frame segment having a plurality of notches placed in opposing pairs in both sides of the continuous screen frame segment (FIG. 15). The notches in opposing pairs provide bending areas of the continuous screen frame segment, with the frame segment bent at each notch to form a rectangular or square screen frame. At each of the three bent corners, corner ends would not be needed for structural integrity, but at least one corner joint insert is inserted at the junction of a first corner end before joining to a second corner end. The continuous screen frame segment includes a first flange extending inwardly from the interior surface of the continuous screen frame segment, with a second flange extending inwardly from the interior surface of the continuous screen frame segment, with the second flange positioned generally parallel to the first flange, creating a gap between the first flange and the second flange. A screen is secured in the gap between the first and second flange. The continuous screen frame segment may be a stainless steel extrusion. The screen may be made from stainless steel. The continuous screen frame segment, after bending, has a corner joint insert inserted into the first corner end opening, spot welded within the opening, with the first corner end spot welded to the second corner end to form a welded junction, suggesting a continuous, seamless and rigid screen frame.

Figure 10:
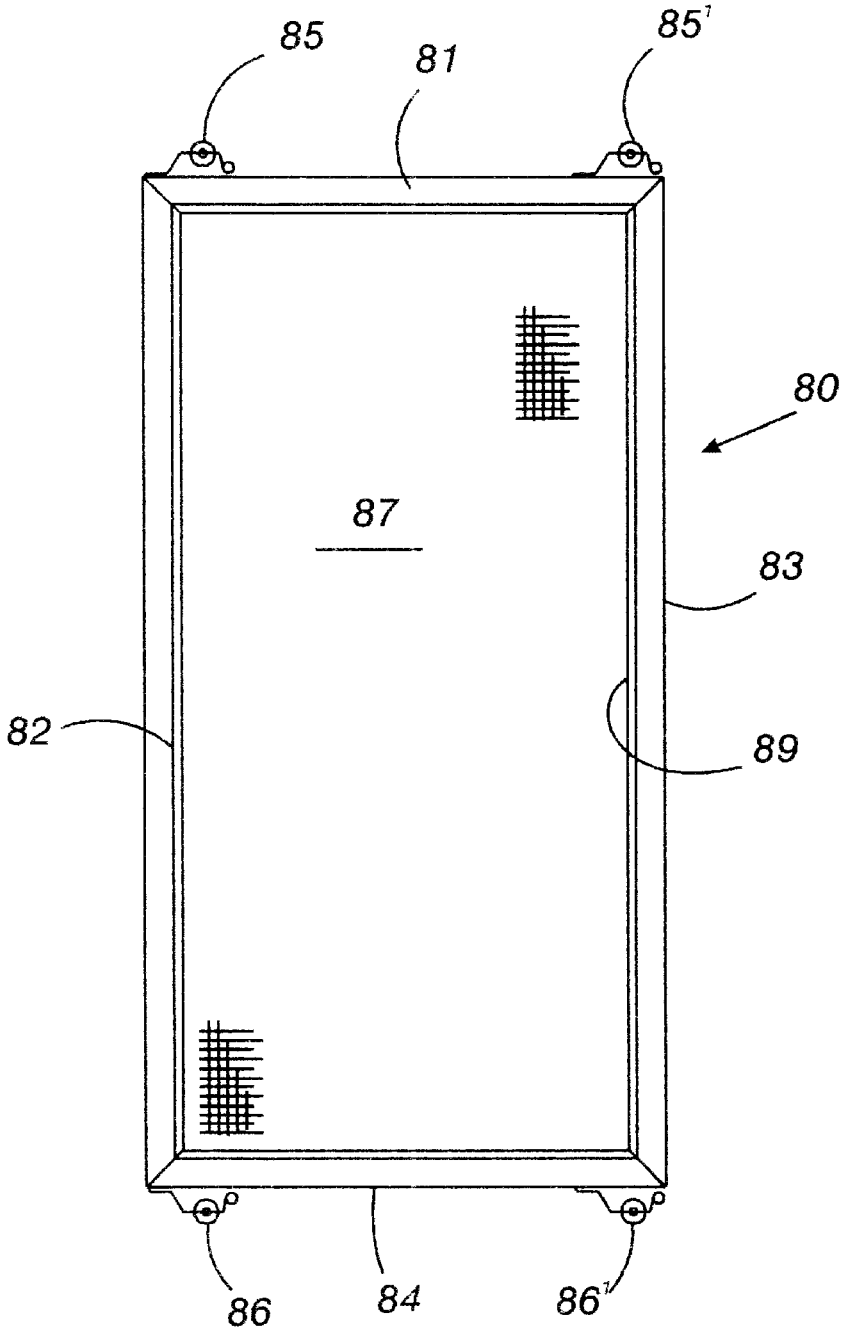
FIG. 10 is a frontal view of a sliding door embodiment of the invented screen frame and screen.
Figure 11:
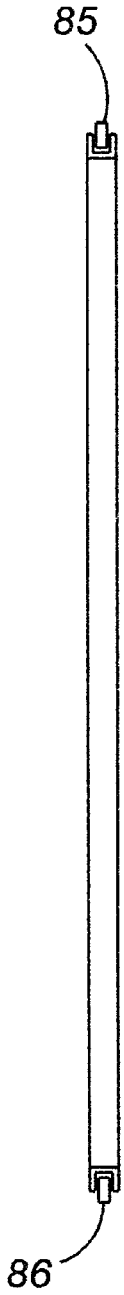
FIG. 11 is an end view of the sliding screen door of FIG. 10.

In a sliding door embodiment, shown in FIGS. 10–11, the top screen frame segment 81 and the bottom screen frame segment 84 have a plurality of rollers 85, 85', 86, 86' which correspond to tracks in the door frame (not shown) which allows the sliding screen door 80 to be rolled on tracks. A metal wire screen 87 is spot welded into the central area of the sliding screen door 80, with the spot welds around the inside perimeter 89 of the top frame segment 81, side frame segments 82, 83, and bottom frame segment 84. The rollers allow the invented screen frame to be used as a sliding screen door. A locking mechanism can also be provided to secure the hinged or sliding door screen frame in a closed position.

Figure 14:
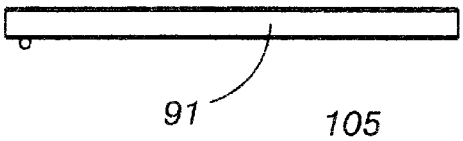
FIG. 14 is a top view of the hinged screen door of FIG. 13.
Figure 12:
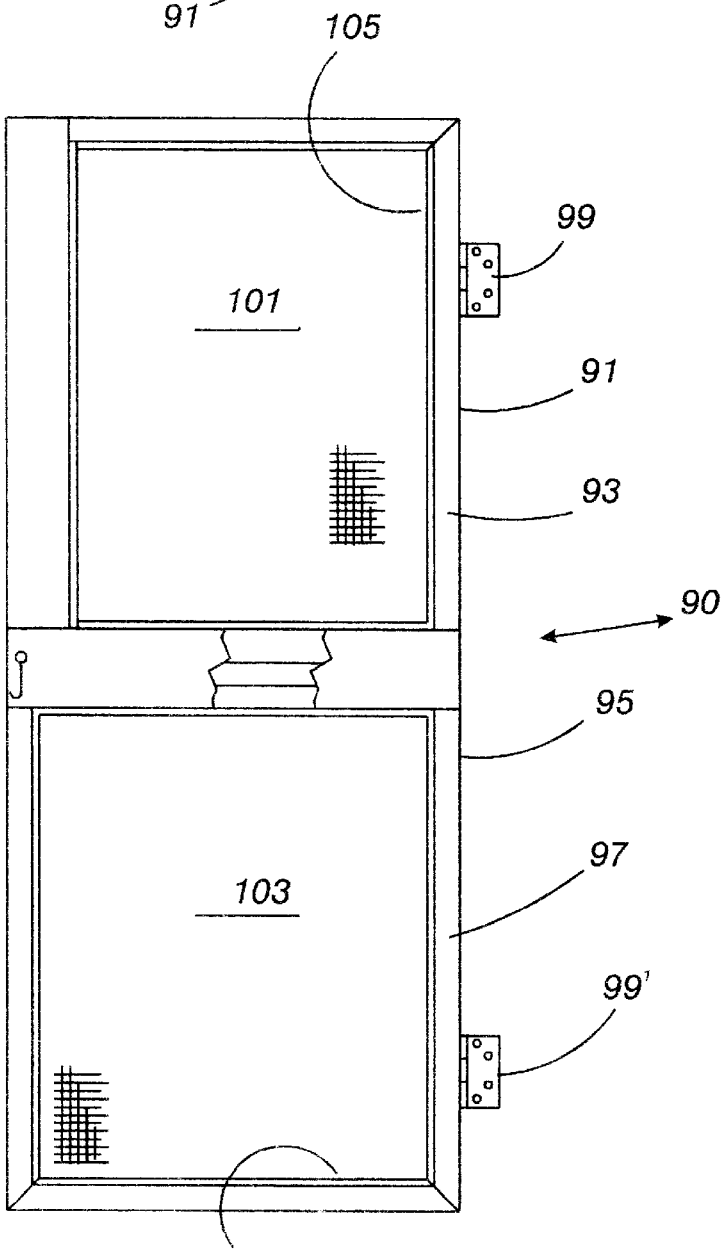
FIG. 12 is a frontal view of a hinged door embodiment of the invented screen frame and screen.
Figure 13:
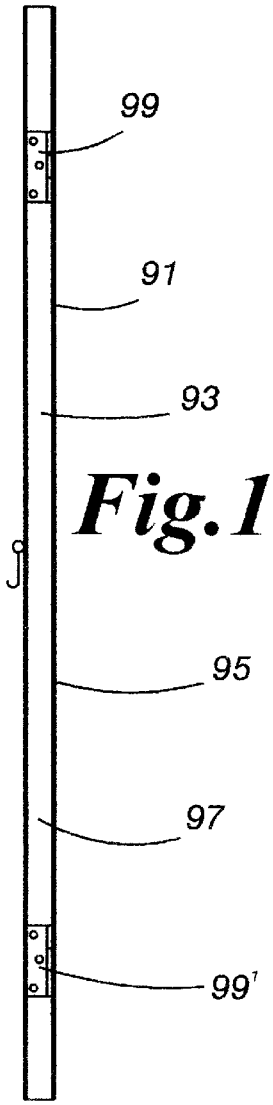
FIG. 13 is an end view of the hinged screen door of FIG. 12.

In a hinged door embodiment, shown in FIGS. 12–14, two screen frames 91, 95 are joined together to form a hinged screen door 90. Hinges 99 and 99' are added to screen frame segment 93 and to screen frame segment 97 to secure the hinged screen door 90 to the door frame (not shown). Metal wire screens 101 and 103 are spot welded into the central area of the screen frames 91, 95 with the spot welds around the inside perimeters 105, 107 of screen frames 91, 95. A locking mechanism can be provided on the opposite side of the door to secure the door in a closed position.

SUMMARY OF THE ACHIEVEMENT OF THE OBJECTS OF THE INVENTION

From the foregoing, it is readily apparent that we have invented a long-lasting screen frame and screen for economically providing a barrier in a window frame or door frame that is sturdy and rigid, is non-corrosive, and may withstand damage from intruders, projectiles, and environmental stresses. The use of stainless steel metal for the screen frame and screen provides security for a home owner, and low maintenance over the life of the screen frame and screen, which may be eight to ten years or more.

It is to be understood that the foregoing description and specific embodiments are merely illustrative of the best mode of the invention and the principles thereof, and that various modifications and additions may be made to the apparatus by those skilled in the art, without departing from the spirit and scope of this invention.

What is claimed is:

1. A screen frame for screening in a window frame or door frame, comprising:

a plurality of screen frame segments having an interior surface and an exterior surface, said plurality of screen frame segments further comprising:

at least one locating pin; and a middle area of each of said plurality of screen frame segments, said middle area having at least one aperture formed through said middle area:

corner ends of each of said plurality of screen frame segments, said corner ends joined to additional corner ends of said plurality of screen frame segments to form a continuous screen frame;

a first flange extending inwardly from a bottom side of said exterior surface of each of said screen frame segments;

a second flange extending inwardly from said interior surface of each of said screen frame segments, said second flange positioned generally parallel to said first flange thereby creating a gap between said first flange and said second flange; and a screen secured in said gap between said first flange and said second flange;

whereas said at least one locating pin passes through one of said at least one aperture, said at least one locating pin contacts said window frame or said door frame.

2. The screen frame of claim 1, wherein each of said plurality of screen frame segments is a stainless steel extrusion, and wherein said screen is made from stainless steel.

3. The screen frame of claim 1, wherein said screen frame further comprises four screen frame segments joined together to form a generally rectangular screen frame.

4. The screen frame of claim 1, wherein said corner ends of each of said plurality of screen frame segments are cut at about a 45 degree angle for flush joining of said plurality of screen frame segments.

5. The screen frame of claim 1, wherein said corner ends further comprise a corner joint insert positioned between and inside adjoining corner ends of each of said plurality of screen frame segments.

6. The screen frame of claim 5, wherein said corner joint insert is spot welded to adjoining corner ends of each of said plurality of screen frame segments.

7. The screen frame of claim 5, wherein said corner joint insert includes a generally rectangular spine and a pair of extensions extending generally perpendicular from said spine, said corner joint insert is positioned in said ends of adjoining screen frame segments, said spine is positioned to face inwardly toward said interior surface of each of said plurality of screen frame segments, and said pair of extensions face outwardly toward said exterior surface of each of said plurality of screen frame segments.

8. The screen frame of claim 7, wherein said pair of extensions has a generally trapezoid profile.

9. The screen frame of claim 7, wherein said pair of extensions has a generally triangular profile.

10. The screen frame of claim 1, wherein said screen secured said gap further comprises a plurality of spot welds in said between said first flange and said second flange of said plurality of screen frame segments.

11. The screen frame of claim 7, wherein said pair of extensions is flexibly connected to said generally rectangular spine in such manner that the pair of extensions exerts outward pressure upon said plurality of screen frame segments.

12. A screen frame for screening in a window frame or door frame, comprising:

a plurality of screen frame segments having an interior surface and an exterior surface;

corner ends of each of said plurality of screen frame segments, said corner ends joined to additional corner ends of said plurality of screen frame segments to form a continuous screen frame;

a first flange extending inwardly from a bottom side of said exterior surface of each of said screen frame segments;

a second flange extending inwardly from said interior surface of each of said screen frame segments, said second flange positioned generally parallel to said first flange thereby creating a gap between said first flange and said second flange;

a corner joint insert positioned between and inside joined corner ends of each of said plurality of screen frame segments, and a screen secured in said gap between said first flange and said second flange;

wherein said screen is spot welded in said gaps between said first flanges and said second flanges of said screen frame segments;

wherein said corner ends of each of said plurality of screen frame segments are spot welded to each respective corner joint insert; and wherein said corner joint insert further comprises:

a generally trapezoid profile:

a generally rectangular spine of said corner joint insert; and a pair of extensions extending from said spine at least about 5 degrees from perpendicular of said spine.

13. The screen frame of claim 12, wherein said corner ends are cut at about 45 degree angle for flush joining of said plurality of screen frame segments.

14. The screen frame of claim 12, wherein each of said plurality of screen frame segments is a stainless steel extrusion, and wherein said screen is made from stainless steel.

15. The screen frame of claim 12, wherein said pair of extensions have a generally trapezoid profile.

16. A screen frame for screening in a window frame or door frame, comprising:

a plurality of screen frame segments having an interior surface and an exterior surface;

corner ends of each of said plurality of screen frame segments, said corner ends joined to additional corner ends of said plurality of screen frame segments to form a continuous screen frame;

a first flange extending inwardly from a bottom side of said exterior surface of each of said screen frame segments;

a second flange extending inwardly from said interior surface of each of said screen frame segments, said second flange positioned generally parallel to said first flange thereby creating a gap between said first flange and said second flange; and a screen secured in said gap between said first flange and said second flange;

said plurality of screen frame segments further comprising:

at least one spring loaded support pin;

a middle area of each of said plurality of screen frame segments, said middle area having at least one bore formed through said middle area;

a spring positioned inside said at least one bore for biasing said at least one spring loaded support pin in an extending position;

a first end of said at least one spring loaded support pin, said first end extending beyond said exterior surface of said plurality of screen frame segments; and a second end extending beyond said inner surface of said at least one screen frame segment;

whereas said at least one spring loaded support pin passes through one of said at least one bore, said at least one spring loaded support pin contacts said window frame or said door frame.

* * * * *